US012011799B2

(12) United States Patent
Lin et al.

(10) Patent No.: US 12,011,799 B2
(45) Date of Patent: Jun. 18, 2024

(54) ELECTRIC KNIFE SHARPENER

(71) Applicant: CUTTWAY PRODUCTS CO., LTD., Taichung (TW)

(72) Inventors: Tzu-Yi Lin, Taichung (TW); Po-Chun Chuang, Taichung (TW)

(73) Assignee: CUTTWAY PRODUCTS CO., LTD., Taichung (TW)

( * ) Notice: Subject to any disclaimer, the term of this patent is extended or adjusted under 35 U.S.C. 154(b) by 384 days.

(21) Appl. No.: 17/545,473

(22) Filed: Dec. 8, 2021

(65) Prior Publication Data

US 2023/0158626 A1 May 25, 2023

(30) Foreign Application Priority Data

Nov. 22, 2021 (TW) ..... 110213818

(51) Int. Cl.

| | |
|---|---|
| ***B24B 3/54*** | (2006.01) |
| ***B24B 3/36*** | (2006.01) |
| ***B24B 19/00*** | (2006.01) |
| ***B24B 27/00*** | (2006.01) |

(52) U.S. Cl.

CPC ..... *B24B 3/54* (2013.01); *B24B 19/002* (2013.01); *B24B 27/0076* (2013.01)

(58) Field of Classification Search

CPC ..... B24B 3/36; B24B 3/54; B24B 19/002; B24B 23/04; B24B 27/0076

USPC ..... 451/45, 164, 349, 356, 552, 553, 555

See application file for complete search history.

(56) References Cited

U.S. PATENT DOCUMENTS

| | | | | |
|---|---|---|---|---|
| 1,909,743 | A * | 5/1933 | Blankner | B24D 15/081 451/449 |
| 2,124,646 | A * | 7/1938 | Barsch | B24D 15/081 451/163 |
| 7,121,935 | B2 * | 10/2006 | Pretorlus | B24D 15/081 76/82 |
| 2004/0014415 | A1 * | 1/2004 | Stallegger | B24D 15/081 451/555 |

(Continued)

FOREIGN PATENT DOCUMENTS

TW M574952 U 3/2019

OTHER PUBLICATIONS

TWM574952, Wu Lie-Shi, Electric Knife Sharpener, Mar. 1, 2019. English Translation (Year: 2019).*

*Primary Examiner* — Eileen P Morgan
(74) *Attorney, Agent, or Firm* — Birch, Stewart, Kolasch & Birch, LLP

(57) ABSTRACT

An electric knife sharpener includes an accommodating unit including a base and an upper cover with a V-shaped opening slot, a driving unit fixed on the base and including a motor and an eccentric wheel, a linkage unit including a linkage mechanism and an upper fixing seat with two limiting rods thereof pivotally connected to an upper part of the upper fixing seat, and a grinding unit. The linkage unit has a guide groove located in a pivot end thereof and coupled to two guiding blocks in a through hole of the upper fixing seat. The grinding unit includes two sharpening components. One end of each sharpening component is pivotally connected in a groove of the linkage mechanism, so that the two sharpening components form a cross arrangement and opposite openings are formed between the two sharpening components to cross a sharpening accommodating space.

3 Claims, 6 Drawing Sheets

(56) References Cited

U.S. PATENT DOCUMENTS

| | | | | |
|---|---|---|---|---|
| 2006/0040598 | A1* | 2/2006 | Koppe | B24D 15/081 451/349 |
| 2006/0040600 | A1* | 2/2006 | Koppe | B24D 15/081 451/359 |
| 2014/0120812 | A1* | 5/2014 | Smith | B24D 15/081 451/552 |
| 2018/0104796 | A1* | 4/2018 | Wu | B24D 15/08 |

* cited by examiner

ELECTRIC KNIFE SHARPENER

BACKGROUND OF THE INVENTION

1. Field of the Invention

The present invention relates to a cutting tool grinding device, especially an electric knife sharpener.

2. Description of the Related Art

Taiwan Patent M574952 discloses an electric knife sharpener. Each sharpening component of this electric sharpener has a pivot hole, and two sharpening components are used as a group, and each pair of sharpening components is pivotally connected to the upper end of a linkage unit. Since there is a stop in the middle of the knife groove, because the two sharpening components are pivotally connected to the same pivot point, the sharpening components will form a separation and clamping action when it is actuated, so it can only be ground on one side at a time. This method is a clip-on method. The blade of the knife ground by this method is not sharp and the appearance is not beautiful. Since the knife can only be sharpened on one side, it often takes a lot of time to trim and grind both sides of the blade. Therefore, the lack of conventional electric knife sharpeners still needs to be improved.

SUMMARY OF THE INVENTION

The present invention has been accomplished under the circumstances in view. It is the main object of the present invention to provide an electric knife sharpener, wherein the sharpening components of the grinding unit and the linkage unit of the electric knife sharpener can provide a better displacement angle grinding effect.

In order to achieve the above object, the present invention proposes an electric knife sharpener, which comprises an accommodating unit, a driving unit, a linkage unit, and a grinding unit. The accommodating unit comprises an upper cover and a base. The upper cover has a V-shaped opening slot. The driving unit comprises a motor and an eccentric wheel. The driving unit is fixed on the base. The linkage unit comprises a linkage mechanism and an upper fixing seat. The upper fixing seat is set in the upper cover below the V-shaped opening slot. The upper fixing seat comprises two limiting rods. Each limiting rod is set in the upper fixing seat. The linkage mechanism comprises a pivot end inserted in the upper fixing seat. The linkage mechanism is drivable by the eccentric wheel to reciprocate along an axial direction. The grinding unit comprises two sharpening components. Each sharpening component has an arc-shaped oblique hole. The limiting rods of the upper fixing seat are respectively inserted through the arc-shaped oblique holes. Each sharpening component has one end thereof pivotally connected to the pivot end of the linkage mechanism. The two sharpening components are pivoted at different pivot points, so that the two sharpening components form a cross arrangement and opposite openings are formed between the two sharpening components to cross a sharpening accommodating space. The two sharpening components are exposed in the V-shaped opening slot of the upper cover.

With the cooperation of the driving unit, the linkage unit and the grinding unit, the cutting tool can be double-sided grinding at the same time, thereby making the blade sharp and beautiful, and shortening the time required for sharpening, thus achieving the object of the present invention.

DETAILED DESCRIPTION OF THE INVENTION

Figure 1:
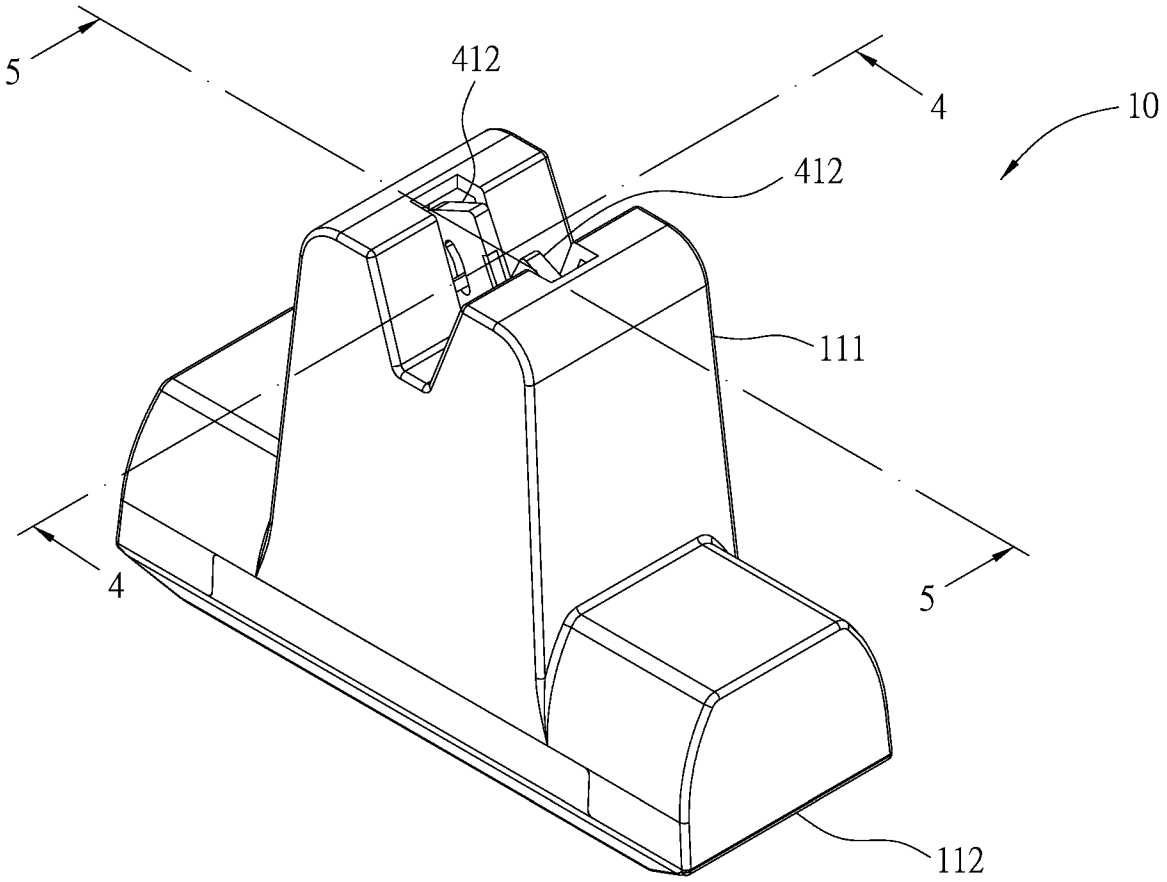
FIG. 1 is an oblique top elevational view of the first preferred embodiment of the present invention, showing the state of the present invention installed in an accommodating unit.
Figure 2:
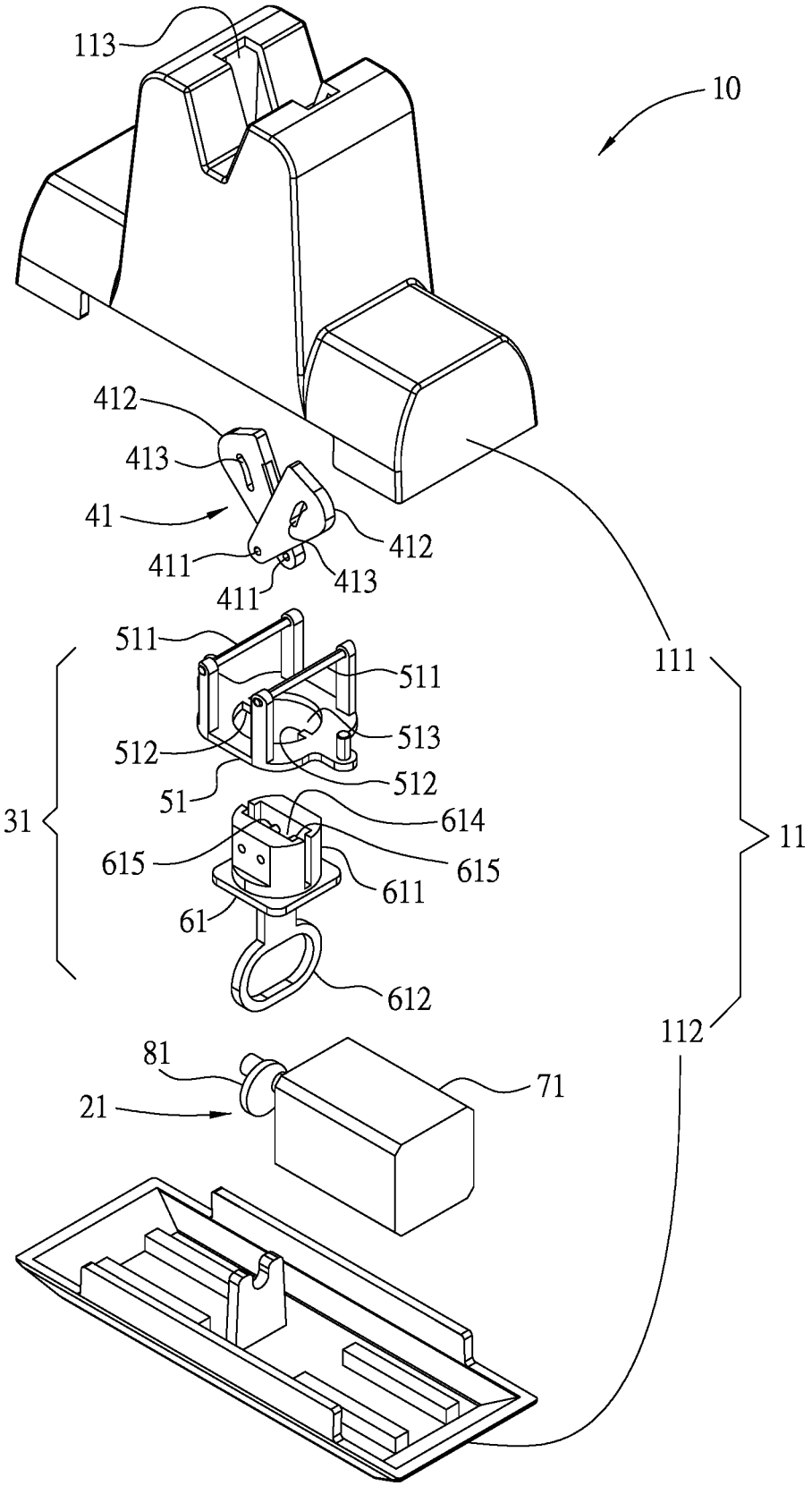
FIG. 2 is an exploded view of the first preferred embodiment of the present invention.

In order to describe in detail the technical features of the present invention, the following preferred embodiment is described in conjunction with the drawings.

Referring to FIG. 1 to FIG. 6, a first embodiment of the present invention discloses an electric knife sharpener 10. The electric knife sharpener 10 is mainly composed of an accommodating unit 11, a driving unit 21, a linkage unit 31, and a grinding unit 41.

Figure 3:
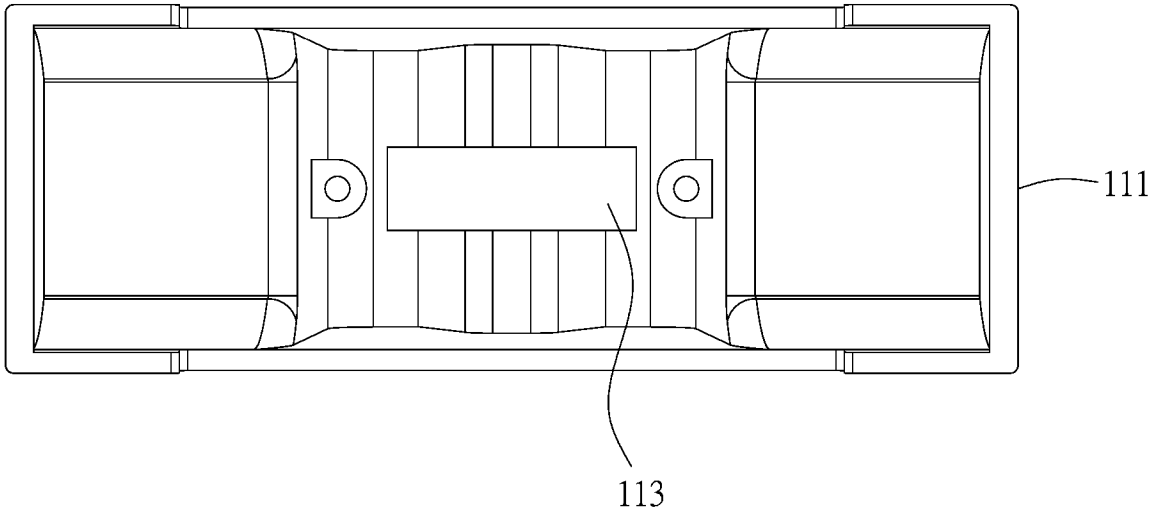
FIG. 3 is a bottom view of the first preferred embodiment of the present invention, showing the internal state of the accommodating unit.
Figure 4:
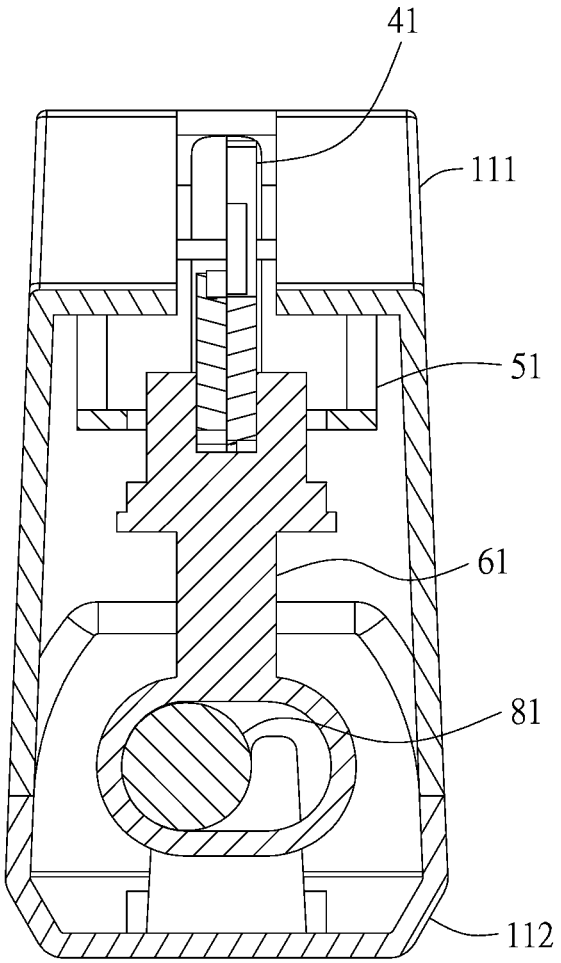
FIG. 4 is a sectional view taken along line 4-4 of FIG. 1.

The accommodating unit 11 comprises an upper cover 111 and a base 112, as shown in FIG. 3, and the upper cover 111 has a V-shaped opening slot 113.

The driving unit 21 comprises a motor 71 and an eccentric wheel 81, and the driving unit 21 is fixed on the base 112.

The linkage unit 31 comprises a linkage mechanism 61 and an upper fixing seat 51. The upper fixing seat 51 has two limiting rods 511, and each of the limiting rods 511 is pivotally connected to the upper part of the upper fixing seat 51 in parallel. The linkage mechanism 61 has a pivot end 611, and the pivot end 611 penetrates through a through hole 513 of the upper fixing seat 51. The linkage mechanism 61 comprises a drive end 612 at a lower side thereof, and a ring located on said drive end 612. Said eccentric wheel 81 is located in said ring to drive said linkage mechanism 61 to move up and down. The through hole 513 is provided with two guiding blocks 512, and the two guiding blocks 512 are arranged on opposite sides of the through hole 513. The pivot end 611 has a guide groove 614 with pins 615 inside, and both ends of the guide groove 614 are respectively connected with the guiding blocks 512. The linkage mechanism 61 of the linkage unit 31 can be driven by the eccentric wheel 81 to move upward and downward along an axial direction.

The grinding unit 41 comprises two sharpening components 412, and each of the sharpening components 412 is provided with an arc-shaped oblique hole 41. The two arc-shaped oblique holes 413 are bent and expanded in opposite directions. The two arc-shaped oblique holes 413 are limited to a limiting rod 511 in the linkage unit 31. One end of each sharpening component 412 has a hole 411, each sharpening component 412 is pivotally connected in a groove of the linkage mechanism 61 via pins 615. The two sharpening components 412 are pivotally connected to different pivot points, so that the two sharpening components 412 form a cross arrangement and opposite opening are formed between the two sharpening components to cross a sharpening accommodating space, and the two sharpening components 412 are exposed in the V-shaped opening slot 113 of the upper cover 111.

The driving unit 21 is installed on the base 112, and the upper cover 111 and the upper fixing seat 51 are screwed together.

Figure 5:
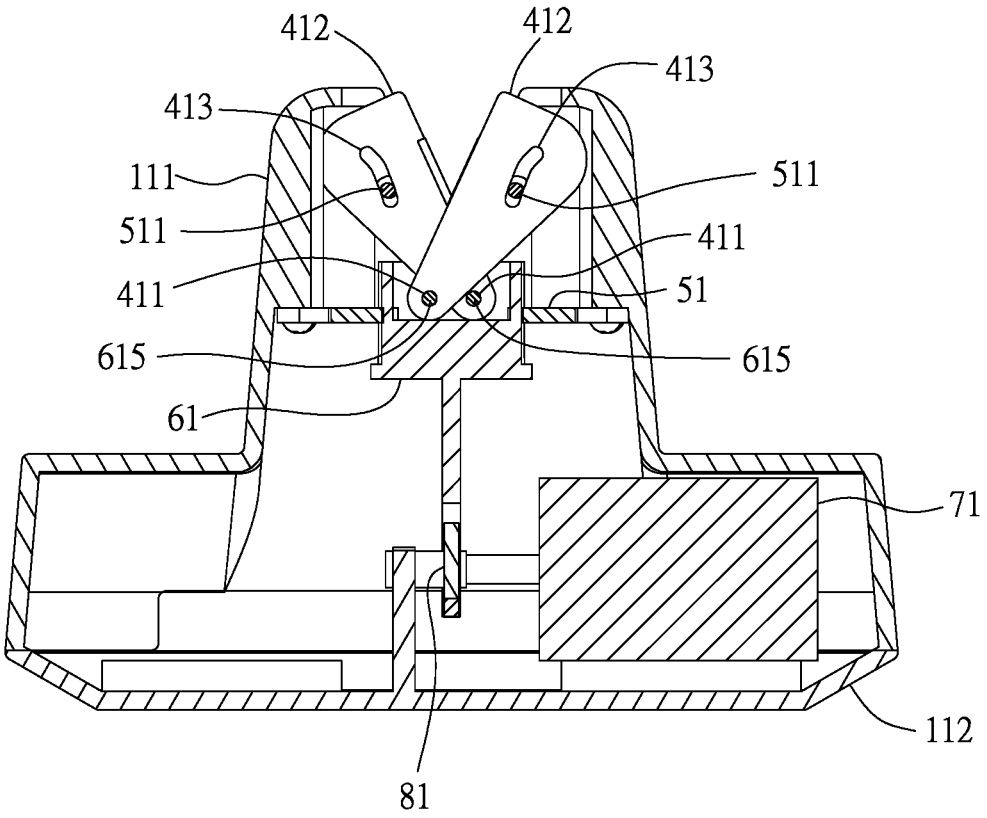
FIG. 5 is a sectional view taken along line 5-5 of FIG. 1.
Figure 6:
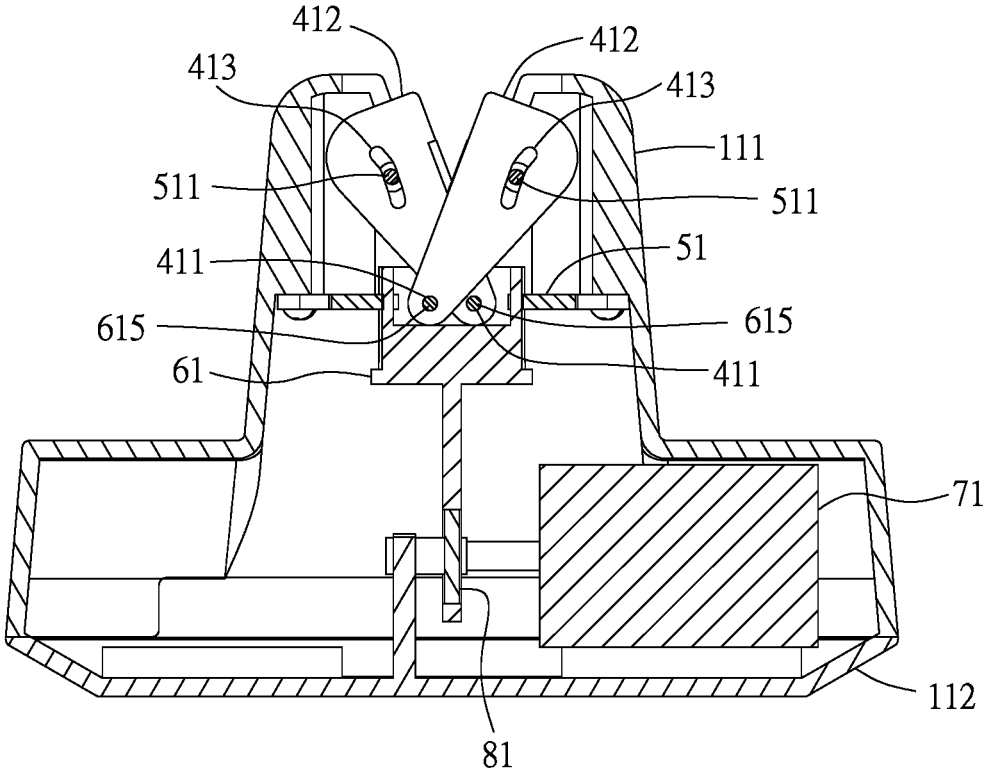
FIG. 6 is similar to FIG. 5, and is a schematic view of the action of the first preferred embodiment of the present invention.

As shown in FIGS. 5 to 6, one end of each sharpening component 412 is pivotally connected to the linkage mechanism 61, and the two limiting rods 511 of the linkage unit 31 are respectively passed through the two arc-shaped oblique holes 413 of the grinding unit 41. When the driving unit 21 drives the linkage unit 31 to act, the linkage mechanism 61 moves upwards to push the two sharpening components 412 of the grinding unit 41 upwards to expand along the shape of the arc-shaped oblique holes, and when the linkage mechanism 61 moves downward, it pushes the two sharpening components 412 downwards to condense in a reciprocating motion. So, each of these two sharpening components moves in an arc track.

It can be seen from the above that the electric knife sharpener 10 of the present invention, compared with the previous clip-on technology, can indeed make the blade of the knife sharper and more beautiful, and shorten the time required for sharpening. In this way, the problems encountered by the aforementioned conventional technologies can be solved.

What is claimed is:

1. An electric knife sharpener, comprising:

an accommodating unit comprising an upper cover and a base, said upper cover comprising a V-shaped opening slot;

a driving unit comprising a motor and an eccentric wheel connected to the motor, said driving unit being fixed on said base;

a linkage unit comprising a linkage mechanism and an upper fixing seat, said upper fixing seat being set in said upper cover below said V-shaped opening slot, said upper fixing seat comprising two limiting rods, each said limiting rod being set in said upper fixing seat, said linkage mechanism comprising a pivot end inserted in said upper fixing seat, said linkage mechanism being drivable by said eccentric wheel to reciprocate along an axial direction; and a grinding unit comprising two sharpening components, each said sharpening component comprising an arc-shaped oblique hole, said limiting rods of said upper fixing seat being respectively inserted through said arc-shaped oblique holes, each said sharpening component having one end thereof pivotally connected to said pivot end of said linkage mechanism, said two sharpening components being crossed at bottom portions thereof and pivotally connected to the linkage mechanism at different pivot points, respectively, so that said two sharpening components form a V-shaped opening defined by top portions of the two sharpening components, wherein each of said arc-shaped oblique holes curves outwardly away from the V-shaped opening from a bottom end of the respectively hole that is closer to the pivot point to a top end, and said top portions of the two sharpening components move apart from each other along said arc-shaped oblique holes when the linkage mechanism moves upwardly, and move toward each other along said arc-shaped oblique holes when the linkage mechanism moves downwardly.

2. The electric knife sharpener as claimed in claim 1, wherein said linkage mechanism has an upper side thereof forming said pivot end, and said pivot end has two opposite sides thereof respectively provided with a guide groove; said upper fixing seat comprises a through hole and two guiding blocks provided in said through hole and respectively set in said guide grooves of said pivot end; said pivot end of said linkage mechanism is inserted into said through hole of said upper fixing seat.

3. The electric knife sharpener as claimed in claim 2, wherein said linkage mechanism comprises a drive end at a lower side thereof, and a ring located on said drive end; said eccentric wheel is located in said ring to drive said linkage mechanism to move up and down.

* * * * *